United States Patent [19]

Murakami

[11] Patent Number: 4,885,071

[45] Date of Patent: Dec. 5, 1989

[54] APPARATUS FOR CONTINUOUS ELECTROLYTIC TREATMENT OF METAL STRIP AND SEALING STRUCTURE FOR ELECTROLYTIC CELL THEREFOR

[75] Inventor: Shinjiro Murakami, Okayama, Japan

[73] Assignee: Kawasaki Steel Corp., Japan

[21] Appl. No.: 167,400

[22] Filed: Mar. 14, 1988

[30] Foreign Application Priority Data

Mar. 17, 1987 [JP] Japan ..... 62-61997

[51] Int. Cl.[4] ..... C25D 17/00

[52] U.S. Cl. ..... 204/206

[58] Field of Search ..... 204/206

[56] References Cited

U.S. PATENT DOCUMENTS

| | | | |
|---|---|---|---|
| 2,918,069 | 12/1959 | Brown, Jr. et al. | 134/122 |
| 4,500,400 | 2/1985 | Komoda et al. | 204/206 |
| 4,632,744 | 12/1986 | Murakamai et al. | 204/206 |

FOREIGN PATENT DOCUMENTS

| | | |
|---|---|---|
| 54-110142 | 8/1979 | Japan . |
| 60-82700 | 5/1985 | Japan . |
| 60-215800 | 10/1985 | Japan . |
| 61-155372 | 9/1986 | Japan . |
| 62-99495 | 5/1987 | Japan . |

*Primary Examiner*—T. M. Tufariello

*Attorney, Agent, or Firm*—Austin R. Miller

[57] ABSTRACT

An electrolytic treatment apparatus has a seal structure for establishing liquid-tight seal at an end of electolyte path. The seal structure comprises a seal roll resiliently biased toward a rotary drum periphery and thus establishing sealing contact with a surface of the metal strip. The seal roll may be cooperative with an elastically deformable sealing member for establishing complete liquid-tight seal.

18 Claims, 3 Drawing Sheets

APPARATUS FOR CONTINUOUS ELECTROLYTIC TREATMENT OF METAL STRIP AND SEALING STRUCTURE FOR ELECTROLYTIC CELL THEREFOR

BACKGROUND OF THE INVENTION

1. Field of the Invention

The present invention relates generally to apparatus for electrolytic surface treatment of a metal strip, for performing electrogalvanizing, electroleadplating, electrogilding, chemical conversion treatment, electrolytic pickling or degreasing and so forth. More specifically, the invention relates to a seal structure for an electrolytic cell which the electrolytic surface treatment apparatus is disposed, which establishes a liquid proof seal for preventing leakage of the electrolyte or electrolytic solution from the electrolytic cell. Further particularly, the invention relates to a seal structure for radial and counter flow type electrolytic treatment apparatus.

2. Description of the Background Art

Radial and counter flow type electrolytic treatment apparatus have been disclosed in the U.S. Pat. No. 4,500,400, issued on Feb. 19, 1985 to Akira Komoda et al. and in the U.S. Pat. No. 4,623,744, issued on Dec. 30, 1986 to Shinjiro Murakami et al, both have been assigned to the common assignee to the present invention. Such counter flow type electrolytic treatment apparatus, particularly electroplating apparatus have proved advantageous because of their capability of forming excellent plating layer.

On the other hand, in order to establish a counter flow of electrolyte or electrolytic solution in a direction opposite the feed direction of the metal strip, substantial pressure should be applied to the electrolyte or electrolytic solution. This pressure in the electrolyte tends to cause leakage of the electrolyte from the electrolytic cell. When leakage of electrolyte occurs, the electrolyte tends to come in contact with the backside surface of the metal strip which should not be treated thereby, resulting in partial corrosion or oxidation.

In order to seal the electrolytic cell, the Japanese Patent First (unexamined) Publication (Tokkai) Showa 60-215800, published on Oct. 29, 1985 and which has also been assigned to the common assignee to the present invention, discloses a seal structure for the electrolytic cell. The disclosed seal structure is successful in preventing leakage of the electrolyte or electrolytic solution. However, on the other hand, a seal segment has to be resiliently depressed onto the metal strip surface for establishing a satisfactorily liquid-tight seal, this tends to cause scratchs on the metal strip and/or the plated layer when dust or so forth adheres on the surface.

On the other hand, the Japanese Patent Second (examined) Publication (Tokko) Showa 49-2264 discloses electrolytic plating apparatus employing a rotary drum serving as supply electrode. In this device, an electrode formed on the rotary drum has to be sealed from the electrolyte so as not to be plated and to maintain electrically conductive contact with the metal strip. For this porpose, an electrode in a form of narrow circumferentially extending strip, is formed at about the axial center of the rotary drum. A rubber or other elastically deformable material seal layer is formed on both sides of the electrode for constantly contacting with the metal strip in a liquid-tight fashion for establishing plating protective seal for the electrode on the rotary drum. In this construction, when the metal strip is wrapped onto the rotary drum, the elastic seal layer tends to become deformed with the result that a step forms between the edge of the electrode. Scratches tend to be formed on the metal strip due to presence of the step between the elastic seal layer and the electrode.

SUMMARY OF THE INVENTION

Therefore, it is an object of the present invention to provide an apparatus for electrolytic treatment of a metal strip, which can solve the problem in the prior proposed seal structure.

Another object of the invention is to provide an electrolytic treatment apparatus which supplies electric current of sufficient density without scratching the metal strip and/or the plated layer.

In order to accomplish the aforementioned and other objects, an electrolytic treatment apparatus, according to the present invention, has a seal structure for establishing a liquid-tight seal at an end of the electolyte path. The seal structure comprises a seal roll which is resiliently biased toward a rotary drum periphery and thus is maintained in sealing contact with a surface of the metal strip. The seal roll may be cooperative with an elastically deformable sealing member for establishing a complete liquid-tight seal.

According to one aspect of the invention, an electrolytic treatment apparatus comprises:

a rotary drum having an outer periphery on which a continuous metal strip is wrapped;

means for defining a electrolytic cell between the outer periphery of the rotary drum, through which the metal strip is fed, the electrolytic cell defining an inlet opening through which the metal strip enters into the cell and an outlet opening through which the metal strip fed out of the cell;

means for discharging electrolyte at a controlled pressure into the electrolytic cell, the electrolyte discharging means being so oriented as to establish a counter flow of electrolyte in a direction opposite to the feed direction of the metal strip;

means for sealing the inlet and outlet openings of the electrolytic cell, the sealing means comprising a seal roll opposing the metal strip surface to be electrolytically treated and biased thereonto for establishing sealing contact, a sealing lip member cooperative with the seal roll to sealingly contact with the metal strip surface for establishing liquid tight seal in cooperation with the seal roll, and a flow resistance member disposed between the discharging means and the seal roll for providing resistance against flow of electrolyte.

According to another aspect of the invention, an electrolytic treatment apparatus comprises:

a rotary drum having an outer periphery on which a continuous metal strip is wrapped;

means for defining a electrolytic cell between the outer periphery of the rotary drum, through which the metal strip is fed, the electrolytic cell defining an inlet opening through which the metal strip enters into the cell and an outlet opening through which the metal strip fed out of the cell;

means for discharging electrolyte at a controlled pressure into the electrolytic cell, the electrolyte discharging means being so oriented as to establish counter flow for flowing electrolyte in a direction opposite to the feed direction of the metal strip;

means for sealing the inlet and outlet openings of the electrolytic cell, the sealing means comprising an elastic sealing member opposing the metal strip surface to be electrolytically treated and biased thereonto for establishing sealing contact, and a flow resistance member disposed between the discharging means and the seal roll for providing resistance against flow of electrolyte.

In the preferred construction, the discharge means is positioned in the vicinity of the outlet opening of the electrolytic cell and has an discharge axis oblique to the longitudinal axis of the electrolytic cell. The electrolytic cell is preferably has an arc-shaped configuration, and the discharge axis of the discharge means intersects a point on the rotary drum at an angle of 45° or less relative to a tangential plane defined at the point. By so selecting the discharge angle, leakage of electrolyte through the outlet side of the electrolytic cell can be prevented.

In practice, the elastic sealing member is so arranged as to define a static pressure chamber in the vicinity of the outlet opening of the electrolytic cell. A flow resistance member is provided in the vicinity of the outlet opening of the electrolytic cell so that the static pressure in the static pressure chamber serves as back pressure against electrolyte flowing through the flow resistance member.

According to a further aspect of the invention, an electrolytic treatment apparatus comprises:

a rotary drum having an outer periphery on which a continuous metal strip is wrapped;

means for defining a electrolytic cell between the outer periphery of the rotary drum, through which the metal strip is fed, the electrolytic cell defining an inlet opening through which the metal strip enters into the cell and an outlet opening through which the metal strip fed out of the cell;

means for discharging electrolyte at a controlled pressure into the electrolytic cell, the electrolyte discharging means being so oriented as to establish counter flow of electrolyte in a direction opposite to the feed direction of the metal strip;

means for sealing the inlet and outlet openings of the electrolytic cell, the sealing means comprising a seal roll an elastic roll body and an electrically conductive section connected to an electric power source, the electrically conductive section having a surface for contacting the surface of the metal strip to supply electric power therethrough.

BRIEF DESCRIPTION OF THE DRAWINGS

The present invention will be understood more fully from the detailed description given herebelow and from the accompanying drawings of the preferred embodiment of the invention, which, however, should not be taken to limit the invention to the specific embodiment but are for explanation and understanding only.

In the drawings.

DESCRIPTION OF THE PREFERRED EMBODIMENT

Figure 1:
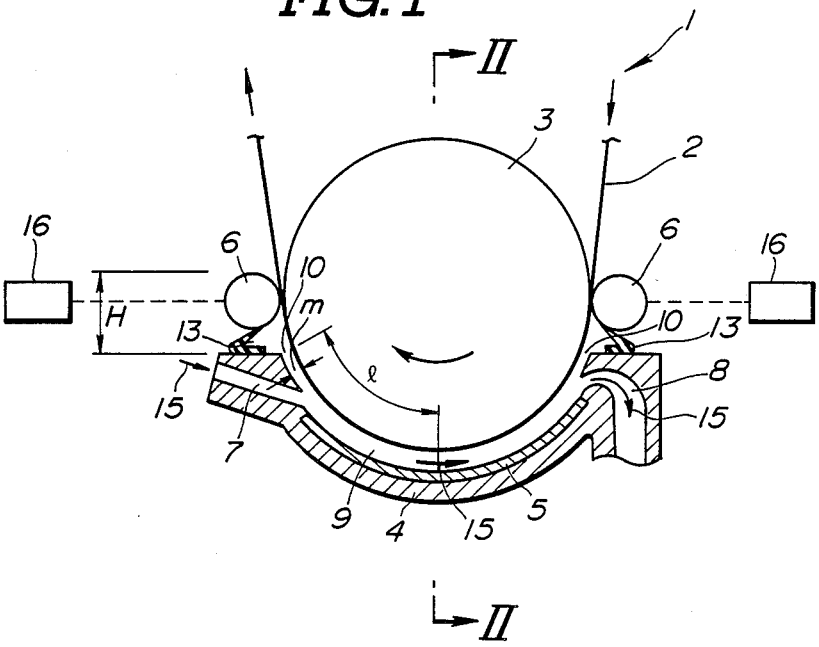
FIG. 1 is a sectional view of the preferred embodiment of an electrolytic treatment apparatus according to the present invention.
Figure 2:
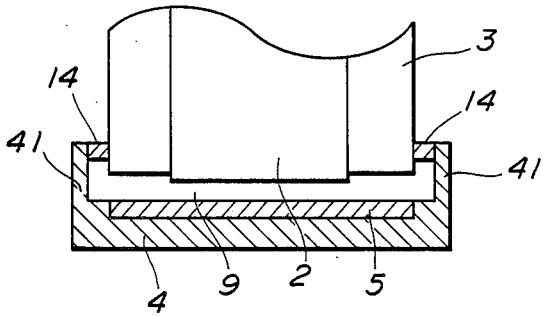
FIG. 2 is a front elevation of the preferred embodiment of the electrolytic treatment apparatus of FIG. 1.
Figure 3:
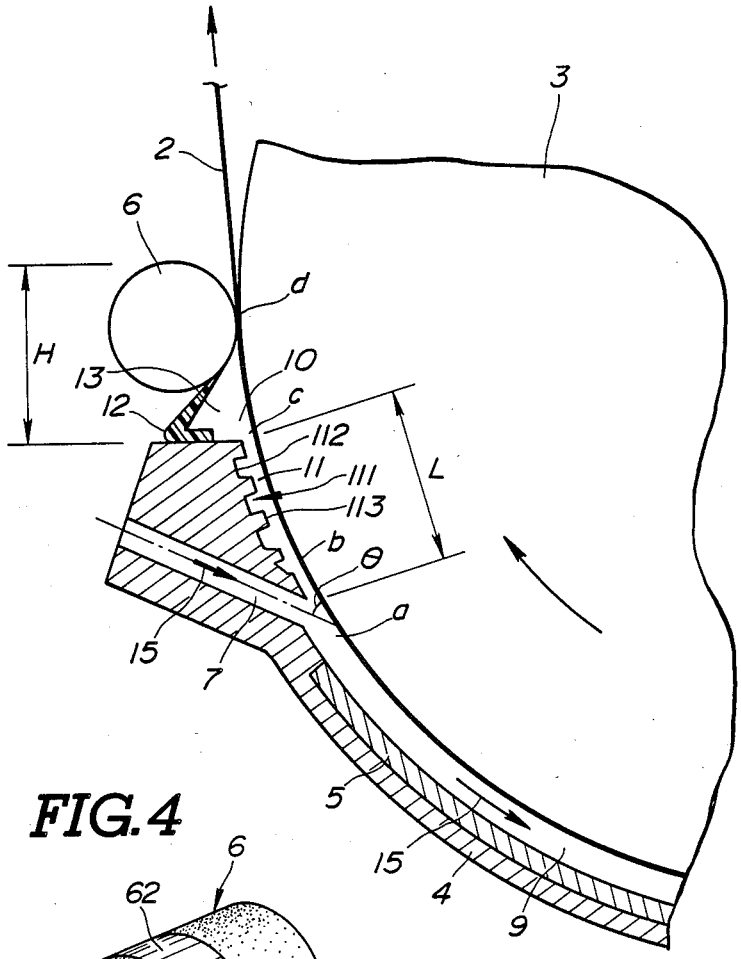
FIG. 3 is an enlarged section of the major part of the preferred embodiment of the electrolytic treatment apparatus, showing the seal structure of the end of a electrolyte path.

Referring now to the drawings, particularly to FIGS. 1 through 3, the preferred embodiment of an electrolytic treatment apparatus 1, according to the invention, has a rotary drum 3. A metal strip 2 is wrapped on the periphery of the rotary drum 3 and continuously fed in a direction shown by arrows in FIGS. 1 and 3. Opposing the surface of the metal strip 2 to be treated, an electrode support 4 with an anode 5 is arranged. Between the rotary drum 3 and the electrode support 4, an elongated and substantially arc-shaped electrolyte or electrolitic solution path 9 is defined.

An electrolyte discharge nozzle 7 and drain 8 of the electrolyte are formed of opposite ends of the electrolyte path 9. The electrolyte discharge nozzle 7 is provided in the vicinity of the upstream end of the electrolyte path 9 which is the downstream side in terms of the feed direction of the metal strip 2. On the other hand, the drain 8 is formed at the downstream end which is the upstream in terms of the metal strip feed direction. With this layout of the discharge nozzle 7 and the drain 8, counter flow of the electrolyte for flowing in a direction opposite to the feed direction of the metal strip 2, can be established.

Discharge pressure of the electrolyte is so selected as to control the flow velocity of the electrolyte in the electrolyte path 9 for obtaining sufficiently high density of electric current. The flow velocity of the electrolyte and current density effective for high efficiency plating has been discussed in the aforementioned U.S. Pat. No. 4,500,400. The disclosure of the U.S. Pat. No. 4,500,400 is herein incorporated by reference for the sake of disclosure.

Both of ends 10 of the electrolyte path 9 are closed by sealing structure, which will be discussed in detail herebelow, so as to prevent leakage of the electrolyte. The seal structure at the outlet side end 10 of the electrolyte path 9 is particularly important, since the electrolyte is a viscous liquid, and therefore tends to be carried off by the metal strip moving through the outlet side end. Electrolyte thus carried tends to contact the back side of the metal strip which may cause corrosion or oxidation thereof. This tendency increases with increase with increase of the feed speed of the metal strip.

The amount of the electrolyte to leak from the oulet side end 10 is also variable depending upon the discharge angle of the electrolyte through the discharge nozzle 7. That is, the amount of leakage tends to increase as the discharge angle $\theta$ relative to a tangent plane defined at the point where the discharge axis intersects the surface of the metal strip increases. The relationship between the discharge angle $\theta$ and the amount of electrolyte leakage is shown in FIG. 3. As will be seen from FIG. 3, the preferred discharge angle $\theta$ is smaller than or equal to 45°. By appropriately selecting the discharge angle, the amount of the electrolyte leakage can be significantly reduced.

However, even by carefully selecting the discharge angle of the electrolyte, leakage of electrolyte cannot be prevented completely. In order to prevent electrolyte from leaking, it is required to provide a seal structure which can effectively seal the ends 10 of the electrolyte path 9, by establishing liquid tight seal with the metal strip 2.

The preferred embodiment of the seal structure, according to the invention, includes a seal roll 6, a seal lip 12 and a labyrinth seal block 11. The seal roll 6 is associated with an actuation unit 16 which is designed to drive the seal roll toward and away from the surface of the metal strip 2 for establishing and releasing sealing contact therebetween.

Figure 4:
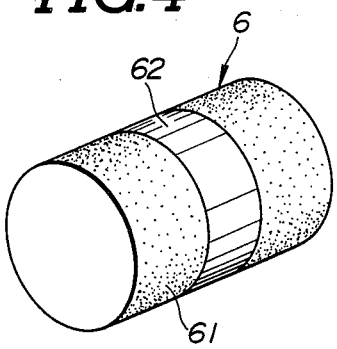
FIG. 4 is a perspective view of the preferred embodiment of a seal roll to be employed in the preferred embodiment of the electrolytic treatment apparatus of FIGS. 1 through 3.

As shown in FIG. 4, the seal roll 6 in the preferred embodiment, comprises a non-conductive elastically deformable roll body 61. The roll body 61 may have an elastically deformable surface layer which is made of rubber, for example. The seal roll 6 also has an electrode section 62 extending circumferentially on the roll body 61. In the preferred construction, the electrode section 62 is located at the middle of the roll body 61 so that elastic portions of the roll body at either side of the electrode support the strip. Preferably, the outer circumferential surface of the electrode section 62 lies flush with the outer periphery of the roll body. With this construction, the electrode section 62 comes into contact with the back side of the metal strip 2 when sealing contact between the metal strip and the seal roll is established. The practical construction of the seal roll 6, which also serves as the power supply medium, has been disclosed in the Japanese Patent First Publication (Tokkai) Showa 62-99495. The disclosure of this Japanese Patent First Publication will be herein incorporated by reference for the sake of disclosure. In addition, the actuator 16 for driving the seal roll 6 toward and away from the metal strip surface may comprise a hydraulic or pneumatic cylinder such as that illustrated in the Japanese Patent First Publication (Tokkai) Showa 60-215800. Disclosure of this Japanese Patent First Publication is herein incorporated by reference for the sake of disclosure.

As will be appreciated, the electrode section 62 is connected to an electric power source to receive therefrom electric power. During electrolytic operation, such as electroplating, electric power is supplied to the metal strip 2 via the seal roll 6. In this case, the length of the flow path of electric current in the metal strip becomes minimum to minimize power loss and heating of in the metal strip.

The seal lip 12 is made of electrically insulative and elastically deformable material. The material for forming the seal slip 12 may, for example, be selected among rubbers, synthetic resins and so forth which have sufficient elasticity for establishing a liquid-tight seal. In addition, since the free end of the seal lip 12 is constantly in contact with the metal strip continuously fed, it is preferable that the material of the seal lip 12 have appropriately high wear-resistance. In view of this, the preferred material for forming the seal lip 12 is chloroprene rubber. The material for forming the seal lip 12 has been disclosed in the Japanese Utility Model First Publication (Jikkai) Showa 61-155372. The disclosure of this Japanese Utility Model Publication is herein incorporated by reference for the sake of disclosure.

As will be seen from FIG. 3, the seal lip 12 has a base section rigidly fixed on the top end plane of the labyrinth seal block 11, and a seal lip section extending from the base section. The free end portion of the seal lip section is cooperative with the seal roll 6 to be pressed onto the surface thereof when the seal roll 6 is placed in the position establishing the seal contact with the metal strip for sealing.

In order to seal the electrolyte path 9 at the axial end portions of the rotary drum 3, seal blocks 14 (FIG. 2) are provided. As will be appreciated, the seal blocks 14 are made of an elestic material, such as rubber, synthetic resin and so forth. A preferable material for forming the seal block 14 is chloroprene rubber which has high wear-resistance. The seal block 14 sealingly contacts both end surfaces of the rotary drum 3 for establishing a liquid-tight seal. Since the seal block 14 must maintain sealing contact with the rotary drum 3 while it rotates, wear-resistance thereof an important factor in selecting the material thereof. The practical construction of the seal block 14 is also disclosed in the afore-mentioned Utility Model First Publication.

The seal blocks 14 are rigidly fixed onto the inner periphery of side walls 41 which extend vertically of the ends of the electrode support 4. In order to electrically insulate the side wall 41 from the rotary drum 3, the seal block 14 must be made of the electrically insulative material.

The labyrinth seal block 11 employed in the shown embodiment, has a corrugated surface 111 (FIG. 3) opposing the metal strip 2 and exposed to the electrolyte in the electrolyte path 9 in the vicinity of the outlet side end 10. The corrugated surface 111 comprises a plurality of longitudinally extending grooves 112 separated by a plurality of laterally extending projections 113. The corrugations of the surface 111 serve to provide flow resistance against the electrolyte flow therethrough. The seal roll 6, the seal lip 12 and the metal strip 2 define a static pressure chamber 13 in the vicinity of the strip outlet side 10 of the electrolyte path 9. Expressed in other words, this creates a resistance zone located in the vicinity of the metal strip outlet where static pressure is established for serving as resistance against flow of electrolyte. Due to the presence of the static pressure chamber 13, a desirable relationship between the pressures in the electrolyte at various points can be established. The electrolyte pressure at respective points a, b, c and d in FIG. 3 can be illustrated by the following formula:

$$a > b > c > d > \text{Atomospheric pressure}$$

The relationship of the pressures at various points in the electrolyte path 9 assures prevention of electrolyte leakage even when the metal strip is fed at a high speed. Furthermore, the pressure relationship makes it possible to effectively cause electrolyte flow from the discharge nozzle 7 to the drain 8.

Though the shown embodiment employs a labyrinth seal block for decreasing the flow velocity of the electrolyte, it is not essential to use a labyrinth seal specifically since any appropriate structural elements which may provide resistance against flow of the electrolyte may be employed. For example, a brush-like element, a partitioned flow path or so forth, may serve as flow resistant element in leu of the labyrinth seal.

In order to confirm the effect of the preferred embodiment of the seal structure for the electrolytic cell, according to the present invention, experiments were conducted. For use in experiments, three cells were provided. No. 1 cell was constructed according to the preferred embodiment set forth above. No. 2 cell was constructed without the labyrinth seal of the preferred embodiment, and the seal structure thereof comprised only seal roll and the seal lip. No. 3 cell was constructed without any seal at the ends of the electrolyte path at all.

Samples of No. 1, No. 2 and No. 3 were identical in construction except for the respective seal structures thereof. The dimensions of the cells were and the electrolyte and metal strip flow rates were as follows:

| | |
|---|---|
| Electrolyte Path Length | 1.5 m |
| Distance between Metal Strip and Anode | 10 mm |
| Strip Width | 900 mm |
| Strip Thickness | 0.9 mm |
| Rotary Drum Axial Length | 1,200 mm |
| Rotary Drum Diameter | 2,000 mm |
| Discharge Nozzle Angle Θ | $0 \leqq \Theta \leqq 75°$ |
| Strip Feed Speed | 100 m/min |
| Electrolyte Flow Velocity | 1 m/sec |

Figure 5:
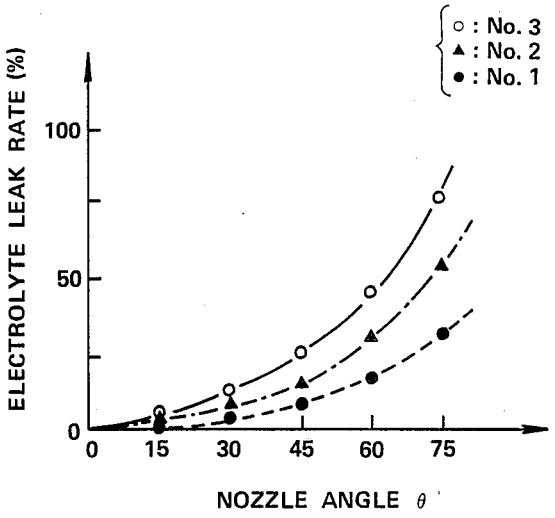
FIG. 5 is a graph showing variation of electrolyte leak rate (%) in relation to electrolyte discharge nozzle angle (°)

Utilizing the aforementioned three cells, electrolyte leakage rate versus the total discharged amount of electrolyte were measured at various discharge nozzle angles. The result of measurement with respect to each of No. 1, No. 2 and No. 3 cells is shown in FIG. 5. As seen from FIG. 5, when the discharge nozzle angle $\theta$ is smaller than equal to 45°, the electrolyte leakage rate becomes substantially smaller. Therefore, the discharge nozzle angle is preferably smaller than or equal to 45° in the preferred embodiment of the electrolytic treatment apparatus.

Figure 6:
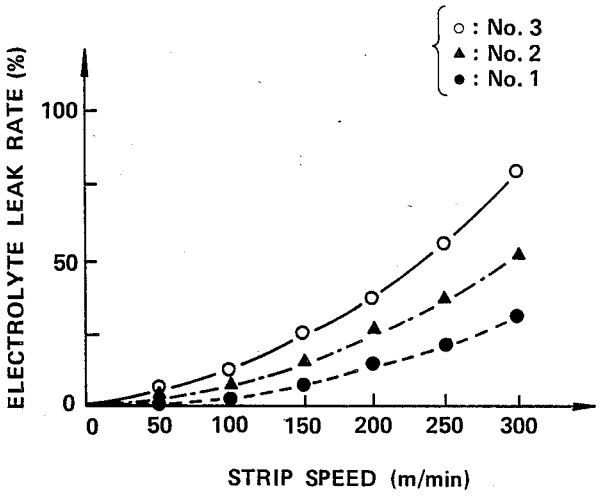
FIG. 6 is a graph showing variation of electrolyte leak rate (%) in relation to strip speed (m/min).

Other experiments were also performed for determining the electrolyte leakage rate in relation to the strip feed speed. For this, the strip feed speed was varied within a range of 50 m/min to 300 m/min. In these experiments, the electrolyte flow velocity was set at 2 m/sec. The results of this experiment are shown in FIG. 6. As will be seen from FIG. 6. In the No. 1 and No. 2 cells, electrolyte leakage rates were substantially smaller than in the No. 3 cell. This confirms the effect of the preferred embodiment of the seal structure.

Additionally, utilizing the No. 2 cell electroleadplating was performed by supplying electric power through the electrode section 62 of the seal roll 6. Power supplied was 2,000A per 100 mm of strip width. The quality of the leadplating layer formed on the strip was excellent. The thickness of the plating metal on the electrode section 62 was measured, and determined to be about 0.05 μm which is small enough to assure that the electrode section may be used for a long period of time without significant degradation of performance thereof.

Therefore, the invention fulfills all of the objects and advantages sought therefor.

While the present invention has been disclosed in terms of the preferred embodiment in order to facilitate better understanding of the invention, it should be appreciated that the invention can be embodied in various ways without departing from the principle of the invention. Therefore, the invention should be understood to include all possible embodiments and modifications to the shown embodiments which can be embodied without departing from the principle of the invention set out in the appended claims.

What is claimed is:

1. An electrolytic treatment apparatus comprising:

a rotary drum having an outer periphery on which a metal strip is wrapped;

means defining an eletrolytic cell in the vicinity of said outer periphery of said rotary drum, through which said metal strip is fed, said electrolytic cell defining an inlet opening through which said metal strip enters into said cell and an outlet opening through which said metal strip is fed out of said cell;

means for discharging electrolyte at a controlled pressure into said electrolytic cell, said electrolyte discharging means being so oriented as to establish a counter flow of electrolyte in a direction opposite to the feed direction of said metal strip;

means for sealing said inlet and outlet openings of said electrolytic cell, said sealing means comprising a seal roll opposing said metal strip surface and biased thereagainst for establishing sealing contact therewith, a sealing lip member arranged to sealingly contact with said seal roll surface for establishing a liquid tight seal with said seal roll, and a flow resistance member disposed between said discharging means and said seal roll for providing a resistance zone located in the vicinity of said outlet where static pressure is established for service as resistance against flow of electrolyte.

2. An electrolytic treatment apparatus as set forth in claim 1, wherein said discharge means is positioned in the vicinity of said outlet opening of said electrolytic cell and has a discharge axis which intersects said strip surface on said rotary drum periphery at a point wherein a tangential plane defined at said point is at an angle with regard to said discharge axis.

3. An electrolytic treatment apparatus as set forth in claim 2, wherein said electrolytic cell is in an arc-shaped configuration, and said angle relative to said plane is smaller than or equal to 45°.

4. An electrolytic treatment apparatus as set forth in claim 1, wherein said seal roll comprises an elastic roll body and an electrically conductive section connected to an electric power source, said electrically conductive section having a surface for contact with the surface of said metal strip for supplying electric power therethrough.

5. An electrolytic treatment apparatus as set forth in claim 1, wherein said seal roll and said seal lip are so arranged as to define a static pressure chamber in the vicinity the outlet opening of said electrolytic cell.

6. An electrolytic treatment apparatus as set forth in claim 1, wherein said flow resistance member comprises a labyrinth seal having an uneven surface exposed to the electrolytic cell.

7. An electrolytic treatment apparatus comprising:

a rotary drum having an outer periphery on which a metal strip is wrapped;

means defining an electrolytic cell in the vicinity said outer periphery of said rotary drum, through which said metal strip is fed, said electrolytic cell defining an inlet opening through which said metal strip enters into said cell and an outlet opening through which said metal strip is fed out of said cell;

means for discharging electrolyte at a controlled pressure into said electrolytic cell, said electrolyte discharging means being so oriented as to establish a flow of electrolyte in a direction opposite to the feed direction of said metal strip;

means for sealing said inlet and outlet openings of said electrolytic cell, said sealing means comprising an elastic sealing member opposing said metal strip surface to be electrolytically treated and biased thereonto for establishing sealing contact, and a flow resistance member located upstream of said electrolyte discharging means and defining a static pressure chamber having an electrolyte pressure which is equal to or greater than the pressure of electrolyte discharged from said electrolyte discharging means, for deterring such discharged electrolyte from leaking through said outlet.

8. An electrolytic treatment apparatus as set forth in claim 7, wherein said discharge means is positioned in the vicinity of said outlet opening of said electrolytic cell and has an discharge axis which intersects the surface of said rotary drum at a point, and wherein a tangential plane defined at said point is at an angle with regard to said discharge axis.

9. An electrolytic treatment apparatus as set forth in claim 8, wherein said electrolytic cell is in an arc-shaped configuration, and said discharge axis intersects said plane at an angle smaller than or equal to 45°.

10. An electrolytic treatment apparatus as set forth in claim 7, wherein said elastic sealing member is so arranged as to define a static pressure chamber in the vicinity of the outlet opening of said electrolytic cell.

11. An electrolytic treatment apparatus as set forth in claim 10, wherein said flow resistance member is provided in the vicinity of said outlet opening of said electrolytic cell so that the static pressure in said static pressure chamber serves as back pressure to the electrolyte flowing through said flow resistance member.

12. An electrolytic treatment apparatus comprising:

a rotary drum having an outer periphery on which a continuous metal strip is wrapped;

means for defining a electrolytic cell in the vicinity of said outer periphery of said rotary drum, through which said metal strip is fed, said electrolytic cell defining an inlet opening through which said metal strip enters into said cell and an outlet opening through which said metal strip is fed out of said cell;

means for discharging electrolyte at a controlled pressure into said electrolytic cell, said electrolyte discharging means being so oriented as to establish a counter flow of electrolyte in a direction opposite to the feed direction of said metal strip;

means for sealing said inlet and outlet openings of said electrolytic cell, said sealing means comprising a seal roll having an elastic roll body and an electrically conductive section connected to an electric power source, said electrically conductive section having a surface to contact with the surface of said metal strip for supplying electric power therethrough.

13. An electrolytic treatment apparatus as set forth in claim 12, wherein said discharge means is positioned in the vicinity of said outlet opening of said electrolytic cell and has an discharge axis which intersects the surface of said rotary drum at a point and wherein a tangenmtial plane defined at said point is at an angle with regard to said discharge axis.

14. An electrolytic treatment apparatus as set forth in claim 13, wherein said electrolytic cell has an arc-shaped configuration, and said discharge axis intersects said plane at an angle smaller than or equal to 45°.

15. An electrolytic treatment apparatus as set forth in claim 12, wherein said sealing means further comprises a flow restricting means for decelerating flow rate of electrolyte at said outlet opening of said electrolytic cell.

16. An electrolytic treatment apparatus comprising:

a rotary drum having an outer periphery on which a metal strip is wrapped;

means defining an electrolytic cell in the vicinity of said outer periphery of said rotary drum, through which said metal strip is fed, said electrolytic cell defining an inlet opening through which said metal strip enters into said cell and an outlet opening through which said metal strip is fed out of said cell;

means for discharging electrolyte at a controlled pressure into said electrolytic cell, said electrolyte discharging means being so oriented as to establish a counter flow of electrolyte in a direction opposite to the feed direction of said metal strip;

means for sealing said inlet and outlet openings of said electrolytic cell, said sealing means comprising a seal roll opposing said metal strip surface to be electrolytically treated and biased thereagainst for establishing sealing contact therewith, a sealing lip member arranged to sealingly contact said seal roll surface for establishing a liquid tight seal with said seal roll, and a flow resistance means oriented upstream of said electrolyte discharging means and defining a static pressure chamber to establish therein a static pressure resisting flow of electrolyte into said static pressure chamber in order to deter electrolyte flow in said feeding direction of said metal strip.

17. An electrolytic treatment apparatus comprising:

a rotary drum having an outer periphery on which a metal strip is wrapped;

means defining an electrolytic cell in the vicinity of said outer periphery of said rotary drum, through which said metal strip is fed, said electrolytic cell defining an inlet opening through which said metal strip enters into said cell and an outlet opening through which said metal strip is fed out of said cell;

means for discharging electrolyte at a controlled pressure into said electrolytic cell, said electrolyte discharging means being so oriented as to establish a counter flow of electrolyte in a direction opposite to the feed direction of said metal strip;

means for sealing said inlet and outlet openings of said electrolytic cell, said sealing means comprising a seal roll opposing said metal strip surface to be electrolytically treated and biased thereagainst for establishing sealing contact therewith, a sealing lip member arranged to sealingly contact said roll surface for establishing a liquid tight seal with said seal roll, and a flow resistance means comprising means defining a static pressure chamber at an orientation upstream of said electrolyte discharging means to establish therein a static pressure resisting flow of electrolyte into said static pressure chamber in order to deter electrolyte flow in said feeding direction of said metal strip, and means defining a path between said electrolyte discharging means and said static pressure chamber and active upon the electrolyte flowing therethrough for decelerating its flow velocity.

18. An electrolytic treatment apparatus comprising:

a rotary drum having an outer periphery on which a metal strip is wrapped;

means defining an electrolytic cell in the vicinity of said outer periphery of said rotary drum, through which said metal strip is fed, said electrolytic cell defining an inlet opening through which said metal strip enters into said cell and an outlet opening through which said metal strip is fed out of said cell;

means for discharging electrolyte at a controlled pressure into said electrolytic cell, said electrolyte discharging means being so oriented as to establish a counter flow of electrolyte in a direction opposite to the feed direction of said metal strip;

means for sealing said inlet and outlet openings of said electrolytic cell, said sealing means comprising a seal roll opposing said metal strip surface to be electrolytically treated and biased thereagainst for establishing sealing contact therewith, a sealing lip member arranged to sealingly contact said seal roll surface for establishing a liquid tight seal with said seal roll, and a flow resistance static pressure chamber upstream of said electrolyte discharging means to establish therein a static pressure resisting flow of electrolyte into said static pressure chamber in order to prevent electrolyte flow in said feeding direction of said metal strip, and means forming labyrinth seal between said electrolyte discharging means and said static pressure chamber and active upon the electrolytic flowing therethrough for decelerating its flow velocity.

* * * * *